US007190372B2

(12) United States Patent
Choi et al.

(10) Patent No.: US 7,190,372 B2
(45) Date of Patent: Mar. 13, 2007

(54) DISPLAY CHARACTERIZATION METHOD AND APPARATUS

(75) Inventors: Heui-keun Choi, Seoul (KR); Du-sik Park, Kyungki-do (KR); Yun-ju Yu, Kyungki-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/196,159

(22) Filed: Jul. 17, 2002

(65) Prior Publication Data

US 2003/0091230 A1 May 15, 2003

(30) Foreign Application Priority Data

Oct. 5, 2001 (KR) ..... 2001-61389

(51) Int. Cl.
*G09G 5/02* (2006.01)

(52) U.S. Cl. ..... 345/589; 345/601

(58) Field of Classification Search ..... 345/600, 345/601

See application file for complete search history.

(56) References Cited

U.S. PATENT DOCUMENTS 5,483,259 A * 1/1996 Sachs ..... 345/600
6,075,888 A 6/2000 Schwartz
6,480,202 B1 * 11/2002 Deguchi et al. ..... 345/600

OTHER PUBLICATIONS

Autiokari, Timo. "AIM: Gamma Terminology". Cached by web.archive.org on Jan. 28, 2001. http://web.archive.org/web/20010128144100/http://www.aim-dtp.net/aim/calibration/gamma_terminology/gamma_terninology.htm.*

* cited by examiner

*Primary Examiner*—Kee M. Tung
*Assistant Examiner*—Aaron M. Richer
(74) *Attorney, Agent, or Firm*—Buchanan Ingersoll & Rooney PC

(57) ABSTRACT

A display characterization method including receiving color characteristic adjustment variable values of a display, as set by a user; calculating color characterization variable values corresponding to the received color characteristic adjustment variable values, using previously stored color characteristic adjustment variable values and their respective color characterization variable values; and rewriting a display device's profile using the calculated color characterization variable values, is provided. Accordingly, it is possible to achieve color matching by reflecting the color adjustment state of a display without using a color measuring apparatus.

15 Claims, 6 Drawing Sheets

FIG. 3

121a

LOOK-UP TABLE OF GAMMA VALUES FOR R, G AND B CHANNELS

300

| BRIGHTNESS | CONTRAST | GAMMA | | |
|---|---|---|---|---|
| | | R CHANNEL | G CHANNEL | B CHANNEL |
| 100 | 100 | 1.69 | 1.67 | 1.67 |
| 100 | 90 | 1.65 | 1.64 | 1.65 |
| 100 | 80 | 1.63 | 1.61 | 1.62 |
| ... | ... | ... | ... | ... |
| 50 | 100 | 2.07 | 2.05 | 2.06 |
| 50 | 90 | 2.07 | 2.05 | 2.06 |
| 50 | 80 | 2.07 | 2.06 | 0.07 |
| ... | ... | ... | ... | ... |
| 0 | 30 | 3.80 | 3.79 | 3.80 |
| 0 | 20 | 4.20 | 4.18 | 4.19 |
| 0 | 10 | 4.88 | 4.87 | 4.87 |

LOOKUP TABLE OF WHITE POINT VALUE

310

| COLOR TEMPERATURE | WHITE POINT VALUE(x,y) | |
|---|---|---|
| | x | y |
| 5000 | 0.346 | 0.358 |
| 5500 | 0.332 | 0.347 |
| 6000 | 0.322 | 0.339 |
| ..... | ..... | ..... |
| 11500 | 0.272 | 0.283 |
| 12000 | 0.269 | 0.280 |

FIG. 4

121b

LOOK-UP TABLE OF
COEFFICIENTS OF GAMMA MATHEMATICAL MODEL 400

| BRIGHTNESS | CONTRAST | COEFFICIENTS OF GAMMA MODEL | | |
|---|---|---|---|---|
| | | a | b | c |
| 100 | 0~100 | −0.0001 | 0.0234 | 0.5104 |
| 90 | 0~100 | −0.0001 | 0.0234 | 0.6220 |
| 80 | 0~100 | −0.0001 | 0.0235 | 0.7210 |
| ... | ... | ... | ... | ... |
| 0 | 0~100 | 0.0003 | −0.0649 | 5.7028 |

LOOK-UP TABLE OF
COEFFICIENTS OF WHITE POINT MATHEMATICAL MODEL 410

| POINT VALUE (x,y) | MATHEMATICAL COEFFICIENTS OF WHITE POINT | | | |
|---|---|---|---|---|
| x | d | e | f | g |
| | $-2*10^{-13}$ | $7*10^{-9}$ | $-8*10^{-5}$ | 0.5914 |
| y | h | i | j | k |
| | $-1*10^{-13}$ | $4*10^{-9}$ | $-6*10^{-5}$ | 0.5519 |

DISPLAY CHARACTERIZATION METHOD AND APPARATUS

Priority is claimed to Patent Application Number 2001-61389 filed in Rep. of Korea on Oct. 5, 2001, herein incorporated by reference.

BACKGROUND OF THE INVENTION

1. Field of the Invention

The present invention relates to a method and an apparatus for display characterization, and more particularly, to display characteristic characterization method and apparatus, which rewrite a display device's profile by reflecting color calibration variable values of a display set by a user in display device's profile.

2. Description of the Related Art

Even if a computer system sends identical control signals (specifying the same combination of electron beam intensities) to different displays, many variables, including differences between various brands of graphics cards and CRT display hardware, variations in the circuitry controlling each of the beams of a display, the age of the phosphor dots on which the beams are incident, the ambient lighting conditions around the display, and the strength of the Earth's magnetic field, will affect the actual color perceived by a user. Thus, it is preferable to measure and calibrate at least two characteristics of a display: "gamma" and "white point".

"Gamma" denotes the relationship between the input digital value (or voltage) sent from a computer system's graphic card and imaging application software to a display and the light intensity emitted from the display. Many variables, including the age and composition of phosphor, the type of graphics cards, the type of display, and ambient lighting condition, will affect this relationship. The "white point" of the displays is the display's color when a computer causes maximum values of red, green and blue light to be emitted from the display.

Electronic devices generally use a kind of file such as a profile, in order to characterize their color reproduction capabilities. The profiles are like a data dictionary recording color data such as the gamut of the electronic device, the characteristics of phosphor or colorant used to generate colors, the brightness and chromaticities of the white point, and the operational mode of the electronic device and are generated in a device characterization process during manufacture of the electronic device.

The color characterization of a color display is performed by measuring output colors (generally corresponding to chromaticity and brightness) with respect to input values (generally corresponding to RGB values) of the display and identifying the relationship between the output colors and the input values. The color characteristics of the display, is stored as a color profile and is used to perform color matching. Accordingly, in order to write a color profile through the color characterization of a display, an expensive color measuring apparatus is necessary.

In some cases, display manufacturers provide with a display device's profile which can be applied only to a single fixed color characteristic state. In other words, the display device's profile can be used only in one particular set of color characteristic conditions, set by the display manufacturers. However, these color characteristic conditions set by the display manufacturer, do not satisfy users' demands to freely change the color characteristics of the display, and need to be changed when the viewing environment changes. Since most displays include means for calibrating colors and their brightness, it is possible to control brightness, contrast, and color temperature which relates to the characteristics of displayed white. When color characteristic conditions previously set by the display manufacturer are changed by a user, the display device's profile does not reflect the changes, and thus color matching between an input device and an output device cannot be carried out correctly.

In the prior art, there is a method for measuring color characteristic variables using a characterization tool having a color sensor, used on a display when color characteristic conditions set by the display manufacturer are changed by a user. However, in the case of using such a color sensor, additional expenses are necessary, and must install the characterization tool in the display control system, such as a computer, and run the characterization tool himself.

In order to solve the above problems, a method for characterizing a color display by visual measurement has been disclosed in U.S. Pat. No. 5,381,349. In this method, a transfer function concerning the brightness characteristics of a display is determined by finding a point at which the brightness of a calibration color patch, comprised of the brightest pixels interposed with the darkest pixels at a certain ratio, matches the brightness of a comparison color patch, and repeating this process using calibration color patches with different ratios of the brightest pixels to the darkest pixels. With this method, the brightness characteristics of the display device can be obtained without using an additional color measuring apparatus; however, the user must repeatedly carry out experiments, and the accuracy of the transfer function obtained from the experiments may vary according to the user. In addition, since this method can give the user only the brightness characteristics of a display, it is impossible to reflect the color temperature characteristics of the device in the display device's profile.

U.S. Pat. No. 6,075,888 discloses a technique of writing a new profile by reflecting new color characteristics of a display in an old profile. In this method, an original profile can be corrected and used. This method uses a color measuring apparatus in order to obtain data required to correct a profile. However, in this method, a user must perform color measurement, and expensive equipment is required.

SUMMARY OF THE INVENTION

To solve the above-described problems, it is an object of the present invention to provide a method and an apparatus for display characterization which can achieve color matching in any color adjustment state, even after a user arbitrarily changes color characteristic adjustment variable values, without using a color measuring apparatus, by writing a display device's profile which reflects changed values.

Accordingly, to achieve an aspect of the above object, there is provided a display characterization method including: receiving color characteristic adjustment variable values of a display, as set by a user; calculating color characterization variable values corresponding to the received color characteristic adjustment variable values, using previously stored color characteristic adjustment variable values and their respective color characterization variable values; and rewriting a display device's profile using the calculated color characterization variable values.

Preferably, the color characteristic adjustment variable values within a predetermined variation range, and their respective color characterization variable values, are stored as a lookup table.

Further, the color characteristic adjustment variables include brightness, contrast, and color temperature, and the color characterization variables include gamma and R, G, and B channel white points.

Preferably, in the step of calculating color characterization variable values corresponding to the received color characteristic adjustment variable values, color characteristic adjustment variable values which most closely approximate each of the received color characteristic adjustment variable values are found in the lookup table, and the color characterization variable values corresponding to the received color characteristic adjustment variable values are calculated by interpolation using the values which approximate each of the received color characteristic adjustment variable values and their respective color characterization variable values.

Preferably, the color characterization variable values are stored as coefficients of a mathematical model of color characteristic adjustment variable values.

Preferably, the color characterization variable values are calculated using the coefficients of the mathematical model of the color characteristic adjustment variable values.

Preferably, an nth-order polynomial expression is used as the mathematical model.

Preferably, the color characteristic adjustment variables include at least one out of brightness, contrast, and color temperature.

Preferably, the color characterization variables include at least one out of gamma and R, G, and B channel white points.

Preferably, the display device's profile is rewritten using the calculated color characterization variables, and R, G, and B primary color points that are previously stored.

To achieve another aspect of the object, there is provided a display characterization apparatus including a display including a means for adjusting color characteristic adjustment variables; a means for storing color characterization variable values corresponding to color characteristic adjustment variable values; a means for calculating color characterization variable values corresponding to received color characteristic adjustment variable values, using the color characterization variable values corresponding to the color characteristic adjustment variable values stored in the color characterization variable storing means; and a means for rewriting a display device's profile using the color characterization variable values calculated by the color characterization variable calculating means.

Preferably, the color characterization variable storing means stores color characterization variable values, corresponding to color characteristic adjustment variable values within a predetermined variation range, as a lookup table.

Preferably, the color characterization variable storing means stores color characterization variable values, corresponding to all combinations of color characteristic adjustment variable values within a predetermined variation range, as a lookup table.

Preferably, the color characterization variable calculation means finds in the lookup table the color characteristic adjustment variable values, which most closely approximate changed color characteristic adjustment variable values, and calculates by interpolation color characterization variable values corresponding to the changed color characteristic adjustment variable values using the values which approximate the changed color characteristic adjustment variable values and their respective color characterization variables.

Preferably, the color characterization variable calculation means finds in the lookup table the color characteristic adjustment variable values, which approximate changed color characteristic adjustment variable values, and calculates by interpolation color characterization variable values corresponding to the changed color characteristic adjustment variable values using the values which approximate the changed color characteristic adjustment variable values and their respective color characterization variables.

Preferably, the color characterization variable storing means stores color characterization variables as coefficients of a mathematical model of color characteristic adjustment variables.

Preferably, the color characterization variable calculation means calculates color characteristic variable values using the mathematical model of the color characteristic adjustment variables.

Preferably, an nth-order polynomial expression is used as the mathematical model.

Preferably, the color characteristic adjustment variables include at least one out of brightness, contrast, and color temperature.

Preferably, the color characterization variables include at least one out of gamma and chromaticities of R, G, and B channels and the white point.

Preferably, the display characterization apparatus further includes a communication means for transmitting color characteristic adjustment variable values, adjusted by the color characteristic adjustment means, to the color characterization variable calculation means.

BRIEF DESCRIPTION OF THE DRAWINGS

The above objects and advantages of the present invention will become more apparent by describing in detail preferred embodiments thereof with reference to the attached drawings in which:

FIG. 3 is a diagram illustrating a lookup table stored in a means for storing color characteristic variables according to the present invention;

FIG. 4 is a diagram illustrating another lookup table stored in another means for storing color characterization variables according to the present invention;

DETAILED DESCRIPTION OF THE INVENTION

Hereinafter, the present invention will now be described more fully with reference to the accompanying drawings.

Figure 1:
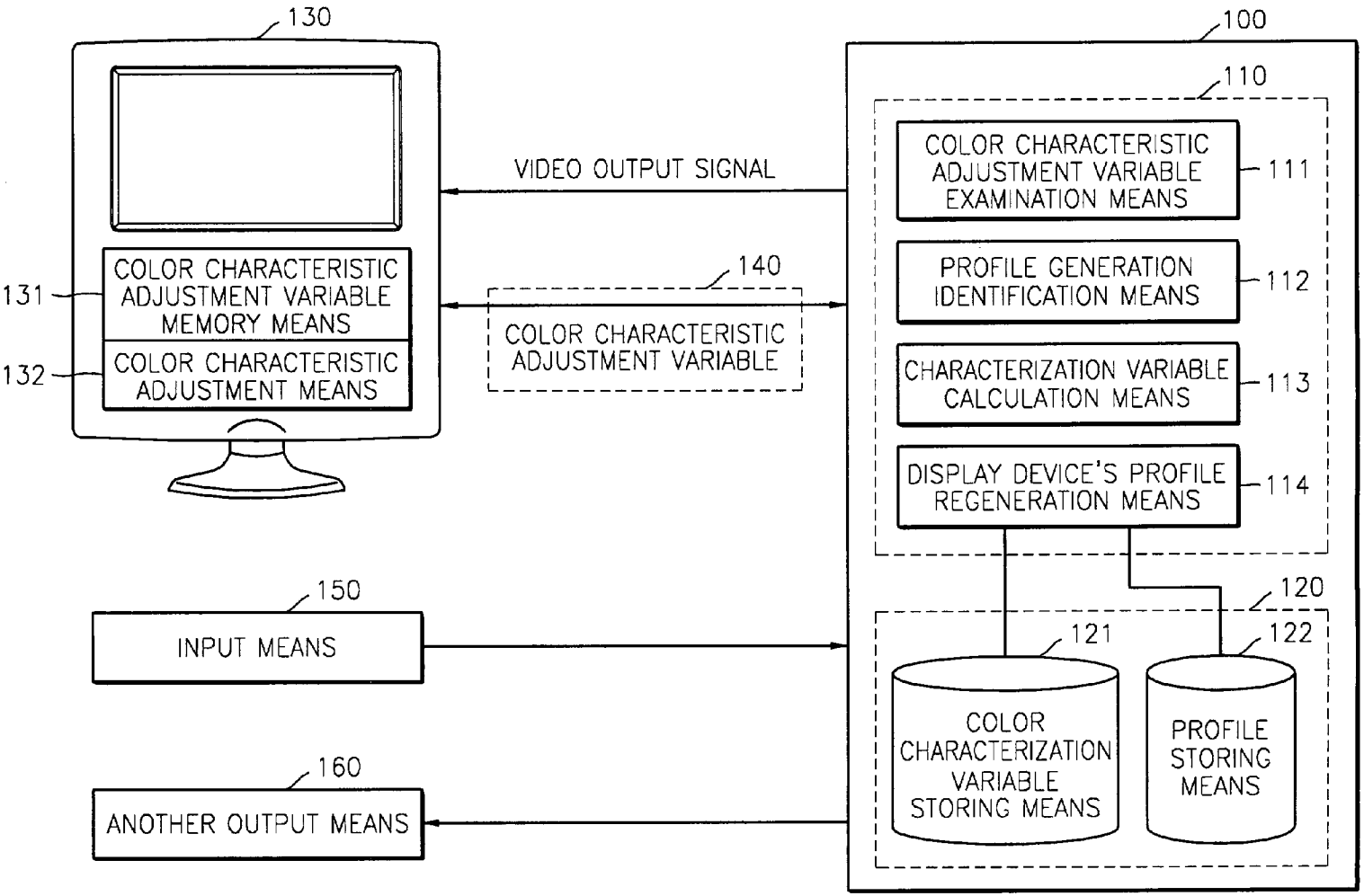
FIG. 1 is a block diagram of a display characterization apparatus according to the present invention.

In FIG. 1, a color output device according to the present invention is illustrated. The color output device system shown in FIG. 1 includes a color control means, such as a computer, 100, which reads color characteristic adjustment variables of a display, computes and stores color characteristic variables, and generates and stores a display device's profile, an output means 130, which includes a color characteristic adjustment means, such as a display, a communication means 140, an input means 150, such as a keyboard or a mouse, and another output means 160, such as a printer.

The output means 130 denotes an output device, such as a display. A display according to the present invention includes a color characteristic adjustment means 132 and a color characteristic adjustment variable memory means 131. The color characteristic adjustment means 132 is introduced for a user to adjust color characteristics adjustment variables including brightness, contrast, and color temperature concerning the characteristics of displayed white point. The color characteristic adjustment variable memory means 131 stores changed color characteristic adjustment variable values when a user changes the setting of the color characteristic adjustment variables using the color characteristic adjustment means 132.

The communication means 140, such as USB, RS232C, or VESA, transmits the changed color characteristic adjustment variable values stored in the color characteristic adjustment variable memory means 131 to the color control means 100.

The color control means 100 includes a processor 110 and a storing means 120. The processor 110 includes a color characteristic adjustment variable examination means 111, a profile generation identifier 112, a characteristic variable calculation means 113, and a display device's profile regeneration means 114. The storing means 120 includes a color characterization variable storing means 121 and a profile storing means 122.

A lookup table, which defines the relationship between the color characteristic adjustment variables, including brightness, contrast, and color temperature, and color characterization variables, including gamma and white point, is stored in the color characterization variable storing means 121. A display device's profile is stored in the profile storing means 122.

The color characteristic adjustment variable examination means 111 determines whether the color characteristic adjustment variables change, in other words, whether the user changes the color characteristic adjustment variables. If any change is made by a color characteristic adjustment variable adjustor of the display, in other words, if the user changes the color characteristic adjustment variables, then, the color characteristic adjustment variable examination means 111 of the processor 110 may receive information on the change of the color characteristic adjustment variable adjustor, or the color characteristic adjustment variable examination means 111 may identify whether or not any change is made by the color characteristic adjustment variables by examining information stored in the color characteristic adjustment variable memory means 131 of the display at time intervals.

The profile generation identifier 112 asks whether the user wants a new display device's profile to be generated by reflecting color adjustment characteristic adjustment variables changed by the user.

If the user decides to generate a new display device's profile by reflecting the changed color characteristic adjustment variables, the characterization variable calculation means 113 calculates color characterization variables corresponding to the changed color characteristic adjustment variables transmitted via the communication means 140 using the lookup table stored in the characterization variable storing means 121.

The display device's profile regeneration means 114 records the color characterization variables (gamma, white point, and RGB primary color points) computed by the characterization variable calculation means 113 at a position corresponding to a profile for color matching, and rewrites the display device's profile.

Hereinafter, the methods for storing the color characterization variables into the color characterization variable storing means 121 will be described with reference to FIGS. 3 and 4. There are two methods for storing color characteristic variables into the color characterization variable storing means 121, The first method is to store the color characterization variables in a lookup table, as shown in FIG. 3, and the second method is to store the color characterization variables as coefficients of a mathematical model.

[Method for Storing Color Characteristic Variables in a Lookup Table]

Figure 6A:
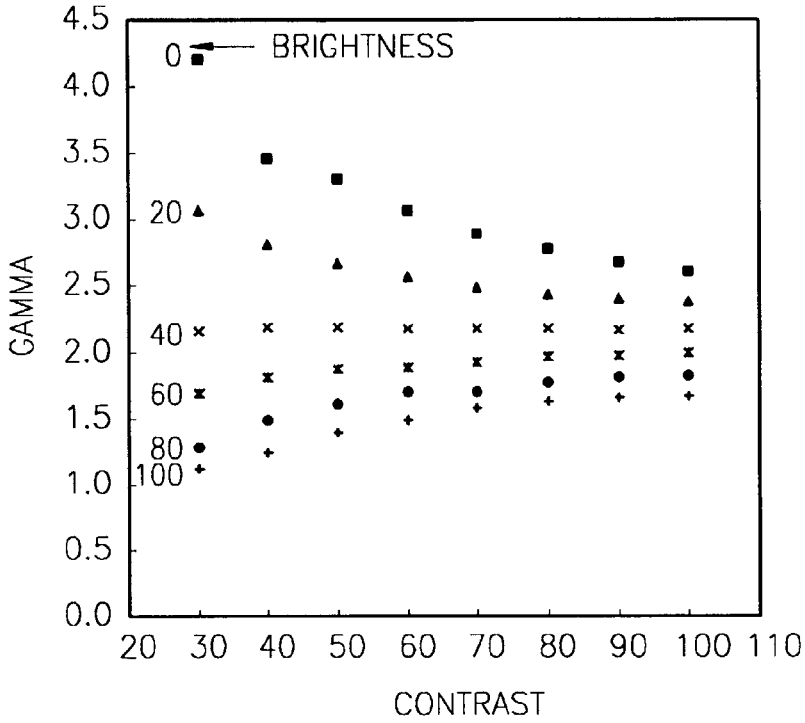
FIG. 6A is a graph showing the variation of a gamma value with respect to color characteristic adjustment variables (brightness, contrast)

As shown in FIG. 3, in the method for storing color characterization variables in a lookup table, a color characterization variable, for example, gamma, is calculated for each RGB channels from the combination of brightness of contrast, color characteristic adjustment variables, varying brightness and contrast of display with predetermined interval over variable range. FIG. 6A is a graph showing variation of gamma values with respect to brightness and contrast. The gamma values (color characterization variable) for all combinations of brightness level and contrast level are stored in the color characterization variable storing means 121 shown in FIG. 1. in the form of a lookup table 300.

In addition, the white point, which is a color characterization variable concerning the temperature of displayed white, is measured at predetermined intervals of color temperature within the entire range of color temperature variations and is stored in the color characterization variable storing means 121 shown in FIG. 1 in the form of a look-up table 310.

The data for the lookup table 300 for gamma, which is a color characterization variable, with respect to brightness and contrast, which are color characteristic adjustment variables of the display, can be generated by the following method. The ranges over which brightness and contrast can vary are divided into predetermined intervals. For example, if brightness and contrast vary over the range of 0–100, the brightness and the contrast may be divided into intervals of 10 or 5, for example. When the brightness and the contrast are divided into intervals of 10, gamma can be obtained by fixing the brightness level at 100 and sequentially varying the contrast level from 100 to 0. This process is repeated until the level of brightness reaches 0. For example, as shown in the lookup table 300 of FIG. 3, in which gamma values are stored, the gamma value of the R channel is 1.69, the gamma value of the G channel is 1.67, and the gamma value of the B channel is 1.67 when brightness and contrast are both at 100.

In addition, the gamma value $\gamma$ of a display represents the relationship between the light intensity of the display and the magnitude of the input signal, and can be obtained from the following equation.

$$Y_n = D_n^{\gamma} \tag{1}$$

In Equation (1), $D_n$ represents the input signal divided by the maximum value of the input signal. For example, if the maximum input signal level of the R, G, and B channels is 256 and the actual input signal level is 100, then $D_n = 100/256$. $Y_n$ represents the output light intensity of the display divided by the maximum output light intensity of the display. Here, the output light intensity of the display is measured at predetermined color characteristic variables, brightness and contrast. Accordingly, gamma is determined as the value which minimizes the error in the value of $Y_n$ obtained from Equation (1), and depends on the value of $D_n$, and the measured output value. The gamma values of R, G, and B channels may be each separately obtained, or the gamma value of a grey channel, in which R, G, and B values are the same, may be obtained. The gamma values of R, G, and B channels are shown in the lookup table 300 of FIG. 3.

Figure 6B:
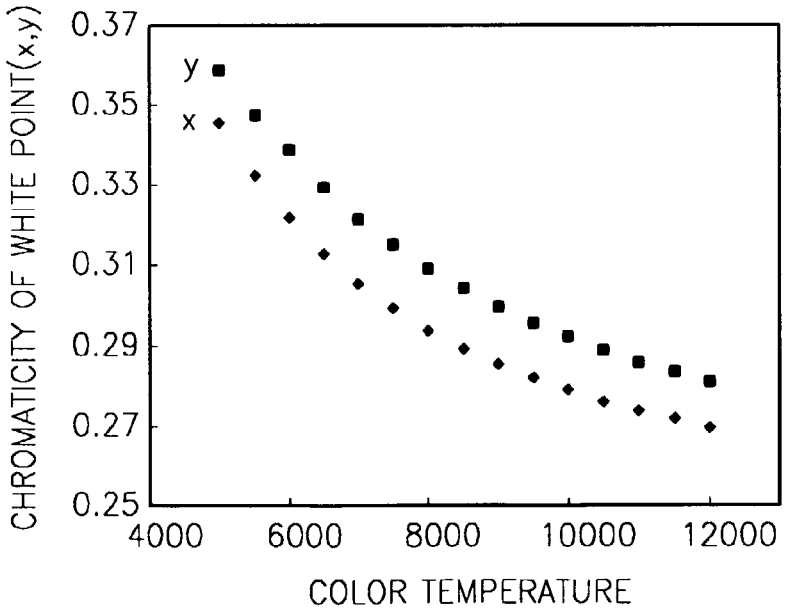
FIG. 6B is a graph showing the variation of the white point with respect to color temperature.

The data for the lookup table 310 for the white point, which is a color characterization variable representing color temperature of a display that is a color characteristic adjustment variable of a display, can be generated by the following method. The color temperature is measured with the brightness and contrast value set to the value which is most commonly used or mid value, since the color temperature is independent of the levels of brightness and contrast. The relationship between color temperature and the white point is shown in FIG. 6B. In order to generate the lookup table 310, the range over which color temperature varies is divided into predetermined intervals. In the case where color temperature varies from 5000° to 12000°, this range can be divided into an interval of 500°, 100°, 50°, or 10°. For example, if the range of color temperature variation is divided into intervals of 500°, the white point is measured at color temperatures of 5000°, 5500°, 6000°, . . . , 11500°, and 12000°, and is stored in the lookup table 310 of FIG. 3. In FIG. 3, color temperature varies from 5000° to 12000°, and the white point is measured at color temperature intervals of 500°.

[Method of Storing Color Characterization Variables as Coefficients of a Mathematical Model]

Hereinafter, a method of storing the relationship between color characteristic adjustment variable values and color characterization variable values as coefficients of a mathematical model will be described with reference to FIG. 4.

When the level of brightness is fixed at a predetermined value and the level of contrast is sequentially varied from 100 to 0, a mathematical model representing the gamma value with respect to contrast is preferably expressed by an nth-order polynomial expression. In the present invention, a $2^{nd}$-order mathematical model can be applied to express the relationship between brightness and contrast, which are color characteristic adjustment variables, and gamma, which is a color characterization variable.

$$G=a*C^2+b*C+c \tag{2}$$

In Equation (2), C represents contrast, G represents gamma, and a, b, and c represent coefficients used to express gamma in terms of contrast. Coefficients of the mathematical model representing gamma with respect to brightness and contrast are shown in a lookup table 400 of FIG. 4.

A mathematical model using an nth-order polynomial expression can also be applied to the variation of the white point (x, y), which is a color characterization variable, with respect to white color temperature, which is a color characteristic adjustment variable. For example, supposing that (x, y) represents the white point, T represents white color temperature, d, e, f, and g represent coefficients used to express 'x' in terms of white color temperature, and h,i,j, and k represent coefficients used to express 'y' in terms of white color temperature, the white point (x, y) can be expressed by the following equations.

$$x=d*T^3+e*T^2+f*T+g \tag{3}$$

$$y=h*T^3+i*T^2+j*T+k$$

Coefficients of a mathematical model representing the relationship between white color temperature and the white point are shown in a lookup table 410 of FIG. 4. In the lookup table 410, the white color temperature of the display varies within a range of 5000°–12000°. However, the white color temperature may have a value lower than 5000° or higher than 12000°.

Figure 2:
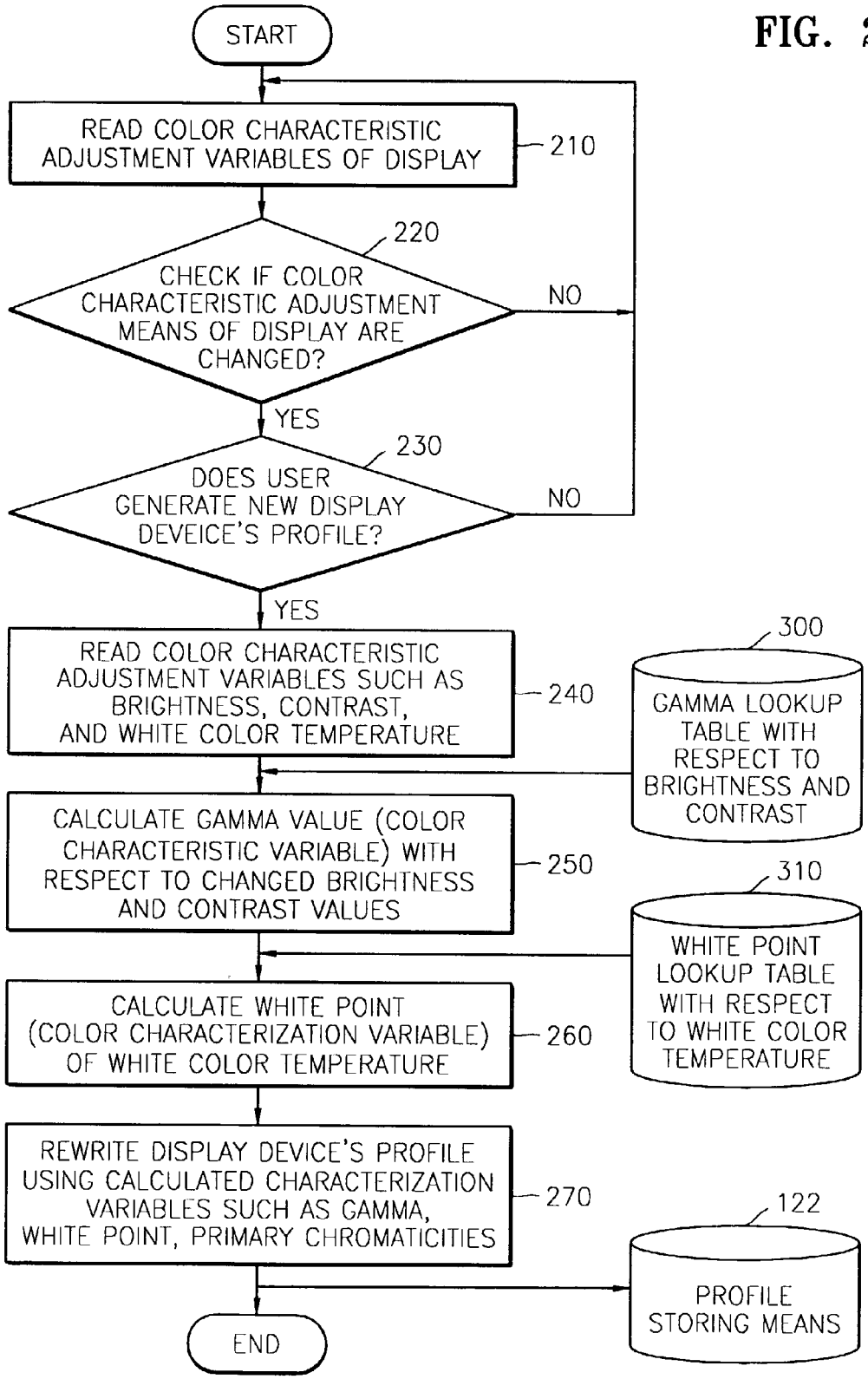
FIG. 2 is a flow chart illustrating the process of writing a new display device's profile by reflecting changed color characteristic adjustment variable values in an original display device's profile.

Hereinafter, a method of generating a display device's profile by reflecting changed color characteristic adjustment variable values according to the present invention will be described with reference to FIG. 2.

In step 210, if a user adjusts brightness, contrast, or white color temperature, which are color characteristic adjustment variables, using the color characteristic adjustment means 132 installed in the display 130, then the new color characteristic adjustment variables are stored by the color characteristic adjustment variable memory means 131 and thus can be read.

Next, in step 220, the color characteristic adjustment variable examination means 111 of the processor 110 identifies whether or not the color characteristic adjustment variables of the display 130 have been changed by the user. If it is determined that the color characteristic adjustment variables are unchanged, then the process returns to the previous step, of identifying whether or not the color characteristic adjustment variables have been changed. On the other hand, if it is determined that the color characteristic adjustment variables of the display 130 have been changed by the user, then the process proceeds to the next step 230 of identifying whether or not to generate a new display device's profile.

In the step 230 of identifying whether or not to generate a new display device's profile, the user is asked whether or not to generate a new display device's profile reflecting the changed color characteristic adjustment variables. In other words, the profile generation identification means 112 of the processor 110 transmits via a user interface a message asking the user whether to generate a new display device's profile reflecting the changed color characteristic adjustment variables to the display 130.

If the user wants a new display device's profile to be generated, then the color characterization variable calculation means 113 calculates color characterization variable values based on the changed color characteristic adjustment variables. The color characterization variable calculation means 113 may read the changed color characteristic adjustment variables from the color characteristic adjustment variable memory means 131 of the display 130, or may draw color characteristic adjustment variables from where they are already stored in a temporary memory means (not shown). In step 240, the color characterization variable calculation means 113 reads brightness, contrast, and white color temperature, which are the changed color characteristic adjustment variables.

Next, in step 250, a gamma value is calculated first, based on the changed brightness and contrast values, using the gamma lookup table 300 stored in the color characterization variable storing means 121, in which gamma values with respect to brightness and contrast values are stored. The gamma lookup table 300 has been described above, and thus its description will not be repeated here. Hereinafter, a process of calculating a gamma value using the gamma lookup table 300 will be described in greater detail.

In the case where various pairs of color characteristic adjustment variable values (brightness and contrast) and their respective color characterization variable values (gamma) are stored in a lookup table, the pairs of color characteristic adjustment variable values which most closely approximate the new color characteristic adjustment variable values set by a user, are found in the lookup table. Next, the color characterization variable values corresponding to the pairs of color characteristic adjustment variable values which most closely approximate the changed color characteristic adjustment values are read from the lookup table, and then a color characterization variable value corresponding to the changed color characteristic adjustment variable values is calculated by interpolation using the pairs of color characteristic adjustment variable values found in the lookup table and their respective color characterization variable values.

Specifically, in the process of calculating a color characterization variable value, gamma, corresponding to the changed color characteristic adjustment variables referring to the lookup table, four pairs of brightness and contrast values approximate the actual brightness and contrast values which as set are newly set by a user, are found in the lookup table, and then a gamma value corresponding to the changed brightness and contrast values is calculated referring to the four pairs of brightness and contrast values approximate to the changed brightness and contrast values and their respective gamma values, by considering a rectangular shape formed by the four pairs of brightness and contrast values and using four-point interpolation. In the case where the changed brightness or contrast value is at the maximum or minimum of its variation range, two pairs of brightness and contrast values which approximate the changed brightness and contrast values are found in the lookup table and a gamma value corresponding to the changed brightness and contrast values is calculated by linear interpolation using the two pairs of brightness and contrast values.

Figure 5A:
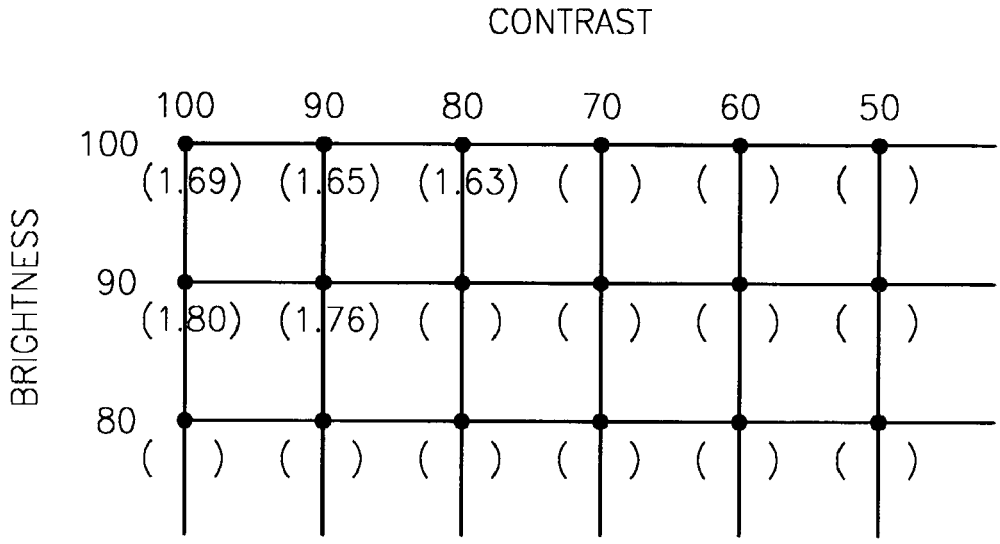
FIGS. 5A and 5B are diagrams illustrating lattice points (brightness, contrast) in order to calculate gamma values according to the present invention.

A method of calculating a gamma value corresponding to the changed brightness and contrast values will be described in greater detail. In FIG. 5A, pairs of brightness and contrast values of the R channel, shown in the lookup table 300 of FIG. 3, are arranged in a lattice shape, and gamma values corresponding to the pairs of brightness and contrast values are shown in parentheses. Referring to FIG. 5A, if color characteristic adjustment variables (brightness, contrast) have values represented by an actual lattice point, for example, if (brightness, contrast) is (100, 100), it is possible to easily find the gamma value corresponding to the brightness and contrast values. However, if the color characteristic adjustment variables do not have the same values as any lattice point, it is impossible to directly find a gamma value corresponding to the color characteristic adjustment variables in the lookup table 300 of FIG. 3. For example, if (brightness, contrast) is (95, 93), it is not possible to directly find a gamma value corresponding to (95, 93) in the lookup table 300 of FIG. 3 since brightness value of 95 and, contrast value of 93 don't exist in the lookup table 300. Accordingly, the gamma value corresponding to (95, 93) can be obtained using four lattice points which most closely approximate (95, 93).

Figure 5B:
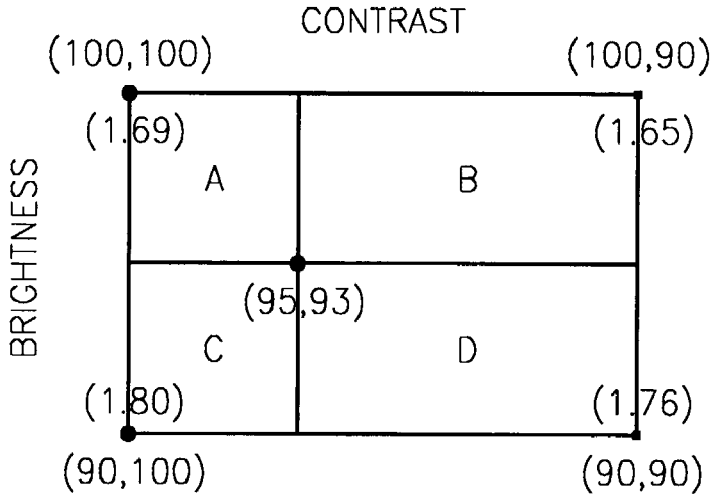

As shown in FIG. 5B, the four lattice points approximate to (95, 93) include (100, 100), (100, 90), (90, 100), and (90, 90). Supposing that the area of the rectangle formed by the four lattice points is represented by S, and the areas of the four small rectangles divided into perpendicular lines drawn from (95, 93) toward the four sides of the rectangle formed by the four lattice points are represented by A, B, C, and D, the gamma value (G) for the R channel which corresponds to (95, 93) can be obtained from the following equation.

$$G = \frac{1.69 \times D + 1.65 \times C + 1.80 \times B + 1.76 \times A}{S} \tag{4}$$

In equation (4), S=A+B+C+D.

In the case where color characterization variable values are stored as coefficients of a mathematical model, the color characterization variable values can be directly calculated based on their respective color characteristic adjustment variable values.

For example, if brightness is 87, and contrast is 50, two brightness values 90 and 80, which most closely approximate 87, can be found in the lookup table 400 of FIG. 4. Gamma values when the brightness value is 80 and the contrast value is 50 and when the brightness value is 90 and the contrast value is 50 are calculated. In other words, supposing that gamma (80, 50) represents the gamma value when the brightness value is 80 and a contrast value is 50 and gamma (90, 50) represents the gamma value when the brightness value is 90 and a contrast value is 50, gamma (80, 50) and gamma (90, 50) can be obtained from the following equations.

$$\text{Gamma (80, 50)} = -0.0001 \times 50 + 0.0235 \times 50 + 0.7210$$

$$\text{Gamma (90, 50)} = -0.0001 \times 50 + 0.0234 \times 50 + -6220$$

Next, gamma (87, 50) is calculated in consideration of the distance between gamma (80, 50) and gamma (90, 50), by two-point interpolation. In other words, gamma (87, 50) can be obtained from the following equation.

$$\text{Gamma}(87,50) = \frac{\text{gamma (80,50)} \times 3 + \text{gamma (90,50)} \times 7}{10} = 1.818.$$

In step 260, once the calculation of a gamma value with respect to brightness and contrast values is completed, the color characterization variable calculation means 131 shown in FIG. 1 calculates the white point (color characterization variable) corresponding to the new white color temperature changed by a user, using the white point lookup table 310 stored in the color characterization variable storing means 121. The calculation of the white point value, like the calculation of the gamma value, can be performed using the white point lookup table 310 or coefficients of a mathematical model.

In step 270, once the a gamma value and white point value corresponding to brightness value, contrast value, and white color temperature value are calculated, the display device's profile regeneration means 114 shown in FIG. 1 rewrites the display devices's profile by recording a new display device's profile in the profile storing means 122 using the calculated gamma and white point values and previously stored R, G, and B primary color chromaticities values.

According to the present invention, even when the user arbitrarily changes the color characteristic adjustment variables of the display, it is possible to perform color matching by generating a new display device's profile to reflect the changed color characterization variables, without using a color measuring apparatus. Thus, it is possible to reduce color matching expenses, and to realize color matching irrespective of the color adjustment state of a display.

What is claimed is:

1. A display characterization method comprising:

receiving color characteristic adjustment variable values of a display set by a user;

finding color characterization variable values corresponding to the received color characterization adjustment variable values from a lookup table storing combinations of color characterization adjustment variable values within a predetermined variation range and color characterization variable values corresponding to each combination of color characterization adjustment variable values, wherein the color characterization adjustment variable include brightness, contrast and white color temperature, and the color characterization variables include gamma with respect to R, G, and B channel and white points, and the gamma γ is obtained from the following equation:

$Y_n=D_n^{\gamma}$, $D_n$ represents the input signal of R, G, B channels divided by the maximum value of the input signal and $Y_n$ represents the output light intensity of the display divided by the maximum output light intensity of the display, the output light intensity of the display reflecting the color characteristic adjustment variable values of the display set by the user, and wherein the lookup table is populated in accordance with the gamma equation and white points measured at predetermined intervals of color temperature within the entire range of color temperature variations; and rewriting a display device's profile using the found color characterization variable values.

2. The display characterization method of claim 1, wherein in the step of finding color characterization variable values corresponding to the received color characteristic adjustment variable values, color characteristic adjustment variable values which most closely approximate each of the received color characteristic adjustment variable values are found in the lookup table, and the color characterization variable values corresponding to the received color characteristic adjustment variable values are calculated by interpolation using the values which approximate each of the received color characteristic adjustment variable values and their respective color characterization variable values.

3. The display characterization method of claim 1, wherein color characterization variable values corresponding to the previously stored color characteristic adjustment variable values are stored as coefficients of a mathematical model of color characteristic adjustment variable values.

4. The display characterization method of claim 3, wherein color characterization variable values are calculated using the coefficients of the mathematical model of the color characteristic adjustment variable values.

5. The display characterization method of claim 3, wherein an nth-order polynomial expression is used as the mathematical model.

6. The display characterization method of claim 1, wherein the color characteristic adjustment variables include at least one out of brightness, contrast, and color temperature.

7. The display characterization method of claim 1, wherein the color characterization variable values include at least one of gamma with respect to R, G, and B channels and white points.

8. The display characterization method of claim 1, wherein the lookup table comprises a first lookup table of R, G, and B channel gamma values corresponding to combinations of brightness and contrast values and a second lookup table of white point values corresponding to white color temperature values.

9. A display characterization apparatus comprising:

a display including a means for adjusting color characteristic adjustment variable values;

means for storing color characteristic variable values corresponding to color characteristic adjustment variable values;

means for finding from said storing means color characterization variable values corresponding to combinations of the color characteristic adjustment variable values within a predetermined variation range and color characterization variable values corresponding to each combination of color characterization adjustment variable values, wherein the color characterization adjustment variables include brightness, contrast and white color temperature, and the color characterization variables include gamma with respect to R, G, and B channel and white points, and the gamma γ is obtained from the following equation:

$Y_n=D_n^{\gamma}$, $D_n$ represents the input signal of R, G, B channels divided by the maximum value of the input signal and $Y_n$ represents the output light intensity of the display divided by the maximum output light intensity of the display, the output light intensity of the display reflecting the color characteristic adjustment variable values of the display set by a user, and wherein the storing means includes a lookup table populated in accordance with the gamma equation and white points measured at predetermined intervals of color temperature within the entire range of color temperature variations; and means for rewriting a display device's profile using the color characterization variable values found by the color characterization variable finding means.

10. The display characterization apparatus of claim 9, wherein the color characterization variable calculation means finds in the lookup table the color characteristic adjustment variable values, which most closely approximate changed color characteristic adjustment variable values, and calculates by interpolation color characterization variable values corresponding to the changed color characteristic adjustment variable values using the values which approximate the changed color characteristic adjustment variable values and their respective color characterization variables.

11. The display characterization apparatus of claim 9, wherein the color characterization variable values storing means stores color characterization variables as coefficients of a mathematical model of color characteristic adjustment variables.

12. The display characterization apparatus of claim 11, wherein the color characterization variable values finding means calculates color characterization variable values using a mathematical model of the color characteristic adjustment variables values.

13. The display characterization apparatus of claim 12, wherein an nth-order polynomial expression is used as the mathematical model.

14. The display characterization apparatus of claim 9, further comprising a communication means for transmitting color characteristic adjustment variable values, adjusted by the color characteristic adjustment means, to the color characterization variable values finding means.

15. The display characterization apparatus of claim 9, wherein the lookup table comprises a first lookup table of R, G, and B channel gamma values corresponding to combinations of brightness and contrast values and a second lookup table of white point values corresponding to white color temperature values.

* * * * *